US007711284B2

(12) United States Patent
Ichikawa et al.

(10) Patent No.: US 7,711,284 B2
(45) Date of Patent: May 4, 2010

(54) CLEANING DEVICE FOR A CHARGING ROLLER OF AN ELECTROPHOTOGRAPHIC SYSTEM

(75) Inventors: Tomoya Ichikawa, Kanagawa (JP); Hideaki Ohike, Kanagawa (JP); Yusuke Kitagawa, Saitama (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 463 days.

(21) Appl. No.: 11/730,968

(22) Filed: Apr. 5, 2007

(65) Prior Publication Data

US 2008/0038010 A1 Feb. 14, 2008

(30) Foreign Application Priority Data

Aug. 9, 2006 (JP) ..... 2006-217184

(51) Int. Cl.
*G03G 15/02* (2006.01)

(52) U.S. Cl. ..... 399/100; 399/102; 399/107; 399/174

(58) Field of Classification Search ..... 399/100
See application file for complete search history.

(56) References Cited

U.S. PATENT DOCUMENTS

| | | | | |
|---|---|---|---|---|
| 5,666,608 | A * | 9/1997 | Christensen | 399/176 |
| 6,385,420 | B1 * | 5/2002 | Morioka | 399/174 |
| 6,665,507 | B1 * | 12/2003 | Hooper et al. | 399/110 |
| 6,810,221 | B1 * | 10/2004 | Meyer et al. | 399/90 |

FOREIGN PATENT DOCUMENTS

| | | |
|---|---|---|
| JP | 09-244417 | 9/1997 |
| JP | 11-065353 | 3/1999 |

* cited by examiner

*Primary Examiner*—David M Gray
*Assistant Examiner*—Roy Yi
(74) *Attorney, Agent, or Firm*—Sheldon J. Moss; Chad M. Herring

(57) ABSTRACT

A cleaning device is disclosed which includes a cleaning member to clean the surface of a charging roll that charges an image carrier. The cleaning member is fixed at one end thereof and contacts at a free end side surface with the surface of the charging roll. The free end of the cleaning member is inserted in between the image carrier and the charging roll. Also disclosed is an image forming apparatus including the cleaning device.

22 Claims, 11 Drawing Sheets

CLEANING DEVICE FOR A CHARGING ROLLER OF AN ELECTROPHOTOGRAPHIC SYSTEM

CROSS-REFERENCE TO RELATED APPLICATION

This application claims priority under 35 USC 119 from Japanese Patent Application No. 2006-217184 filed Aug. 9, 2006.

BACKGROUND

1. Technical Field

The present invention relates to an image forming apparatus, such as a copier or printer, which adopts an electrophotographic system, and particularly to a cleaning device for cleaning a charging roll that charges the surface of an image carrier to be rotationally driven and to an image forming apparatus including such a cleaning device.

2. Related Art

A contact charging system that charges an image carrier by directly contacting a conductive charging roll with the image carrier is mainly used in recent days as a charging device of an image forming apparatus, such as a copier or printer, which adopts an electrophotographic system, because generation of ozone or nitrogen oxide can be reduced to a great extent and such as system has good power supply efficiency.

In such a contact charging type charging device, the charging roll and image carrier are always in contact with each other, and thus friction between the charging roll and a photoreceptor causes a charging history on the charging roll surface to occur when storing for a long period at the shipping stage of the image forming apparatus. Additionally, a conductive material coated in the surface layer of the charging roll oozes, causing the problem of adherence of the conductive material on the surface of the image carrier.

SUMMARY

An aspect of the invention provides a cleaning device having a cleaning member that cleans a surface of a charging roll that charges an image carrier. The cleaning member is fixed at one end thereof, a surface on a free end of the cleaning member is disposed in contact with the surface of the charging roll, and the free end of the cleaning member is inserted in between the image carrier and the charging roll.

BRIEF DESCRIPTION OF THE DRAWINGS

Exemplary embodiments of the present invention will be described in detail based on the following figures, in which.

DETAILED DESCRIPTION

An image forming apparatus according to an exemplary embodiment of the present invention will be described with reference to drawings hereinafter.

<Configuration of Image Forming Apparatus>

Figure 1:
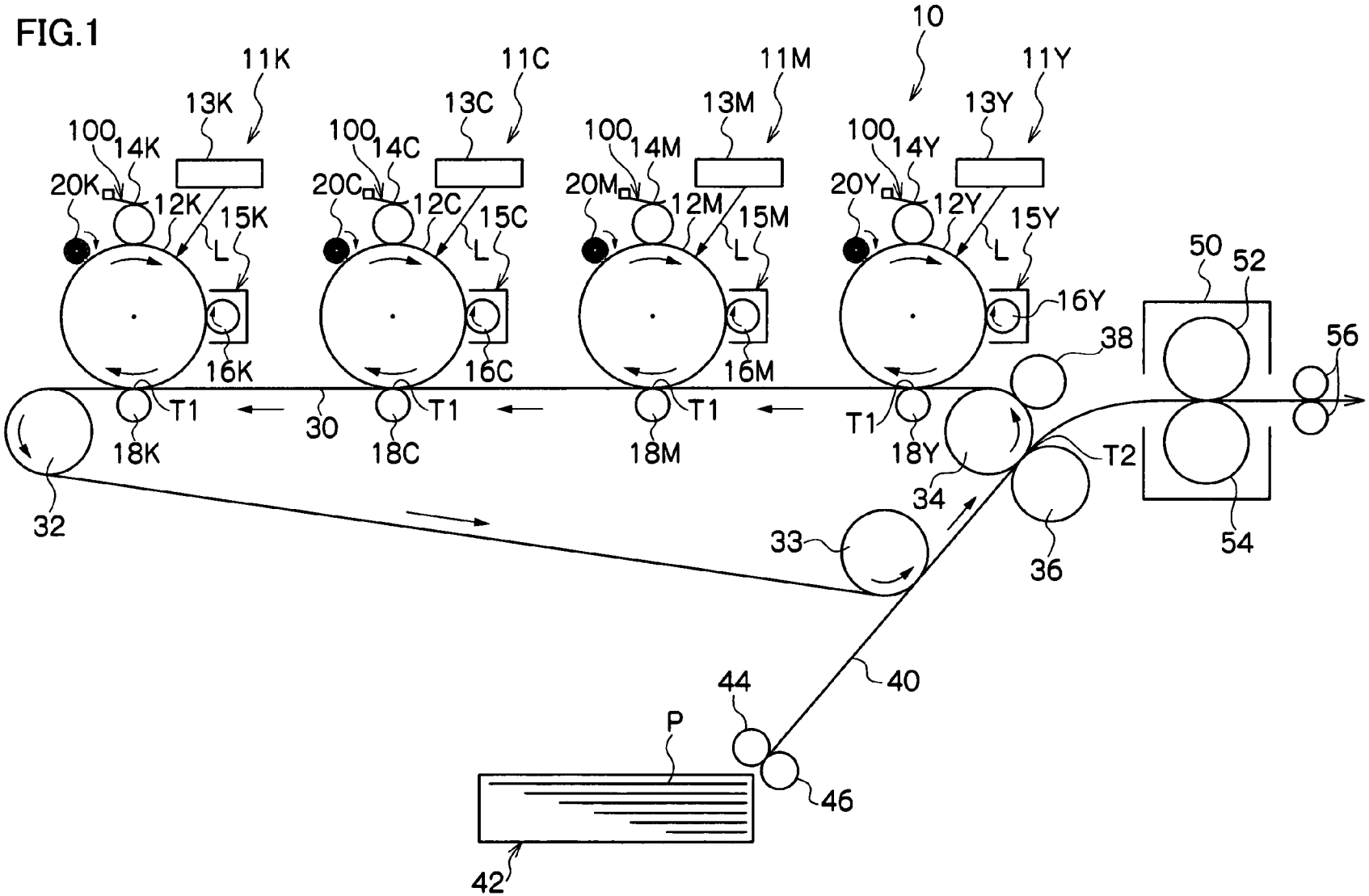
FIG. 1 is a configurational diagram showing a schematic configuration of an image forming apparatus according to one exemplary embodiment of the invention.

An image forming apparatus 10 of this exemplary embodiment shown in FIG. 1 is a quadruple tandem system color printer. Image forming units 11 (11Y, 11M, 11C, 11K) that form a toner image of each color of Yellow (Y), Magenta (M), Cyan (C) and Black (K) are disposed in juxtaposition with each other along the direction of movement of an intermediate transfer belt 30, as shown in the figure.

The image forming units 11 include photoreceptor drums 12 (12Y, 12M, 12C, 12K) as image bearing bodies. Each of the photoreceptor drum 12 uses, for example, a conductive cylinder coated on its surface with a photoreceptor layer of an organic photoconductor, and is rotationally driven by an unillustrated motor in the direction indicated by arrow A (right-handed rotation direction) in the drawing at a predetermined process speed.

Right above the photoreceptor drums 12 are placed charging devices equipped with charging rolls (contact chargers) 14 (14Y, 14M, 14C, 14K) that charge the surfaces of the photoreceptor drums 12. Further, above the photoreceptor drums 12 are provided exposure devices 13 (13Y, 13M, 13C, 13K) that irradiate light beams L onto the surfaces of the photoreceptor drums 12 so as to form electrostatic latent images.

Developing devices 15 (15Y, 15M, 15C, 15K) are placed on the right sides of and adjacent to the photoreceptor drums 12. The developing devices 15 include developing rolls 16 (16Y, 16M, 16C, 16K) that develop electrostatic latent images on the photoreceptor drums 12 into toner images of the respective colors of Y, M, C and K.

Under the photoreceptor drums 12 is provided an endless intermediate transfer belt 30 onto which visualized toner images are transferred by the developing device 15. Further, primary transfer rolls 18 (18Y, 18M, 18C, 18K) are provided in opposing relationship to the photoreceptor drums 12 in a manner such that the intermediate transfer belt 30 is held therebetween. Each contact site between the photoreceptor drums 12 and the intermediate transfer belt 30 is a primary transfer portion T1, and a primary transfer bias of positive polarity is applied to the primary transfer rolls 18.

Cleaning devices are provided on the left sides of and adjacent to the photoreceptor drums 12 as photoreceptor cleaners that remove transfer residual toner remaining on the photoreceptor drums 12 after the primary transfer. The cleaning devices include brush rolls 20 (20Y, 20M, 20C, 20K) for rubbing off the transfer residual toner from the photoreceptor drums 12 by being rotationally driven in the direction opposite to the rotational direction of the photoreceptor drums 12 while being pressure-contacted with the circumferential faces of the photoreceptor drums 12.

The intermediate transfer belt 30 is entrained around a drive roll 32, a tension roll 33 and a secondary backup roll 34, and rotationally moved in synchronism with the rotation of the receptor drums 12 and in the same direction as the rotational direction of the photoreceptor drum 12. Further, the image forming units 11Y, 11M, 11C, and 11K are arranged in series in that order with respect to the direction of movement of the intermediate transfer belt 30. Thus, the toner images on the photoreceptor drums 12 are primary-transferred by the primary transfer rolls 18 onto the intermediate transfer belt 30 in a manner that are superimposed in the order of yellow, magenta, cyan and black at the respective primary transfer portions T1, and the intermediate transfer belt 30 transports the primary-transferred toner images to a secondary transfer portion T2 (secondary transfer roll 36) which will be described below.

The secondary transfer roll 36 is provided on the right side of the intermediate transfer belt 30 in opposing relationship to the secondary backup roll 34 in a manner that holds a paper transport path 40 therebetween. The contact site of the secondary transfer roll 36 and intermediate transfer belt 30 is a secondary transfer portion T2, and a secondary transfer bias of negative polarity is applied to the secondary transfer roll 36. Thus, the secondary transfer 36, being assisted by the secondary backup roll 34, causes the toner images, which are primary-transferred onto the intermediate transfer belt 30, to be secondary-transferred onto a paper sheet P at the secondary transfer portion T2. Further, at an upper right position relative to the secondary transfer backup roll 34, which rotationally supports the intermediate transfer belt 30, an intermediate transfer belt cleaner 38 is provided for removing transfer residual toner remaining on the intermediate transfer belt 30 after the secondary transfer.

A paper feed tray 42, which accommodates paper sheets P, is placed below the intermediate transfer belt 30. On the right hand side of and adjacent to the supply tray 42 are provided a feed roll 44 for feeding the paper sheets P out to the paper transport path 40 from the paper feed tray 42 and a retard roll 46 for separating the fed-out paper sheets P one by one.

Further, a fixing device 50 including a heating roll 52 and a pressure roll 54, which are disposed in opposing relationship to each other, is provided downstream of the secondary transfer portion T2 in the paper transport path 40, and a discharge roll pair 56 is provided downstream of the fixing device 50. The paper transport path 40 is provided in a manner that extends from the feed roll and retard roll to the discharge rolls 56 via the secondary transfer portion T2 and the fixing device 50.

(Image Forming Operation of an Image Forming Apparatus)

Description will next be made of the color image forming operation of the image forming apparatus 10 according to this exemplary embodiment.

When the photoreceptor drum 12 is rotationally driven in response to an image forming signal input to the image forming apparatus 10, the charging roll 14 is rotated together with the rotation of the photoreceptor drum 12, and the surface (outer circumferential surface) of the photoreceptor drum 12 is uniformly charged via the charging roll 14. Subsequently, the surface of the photoreceptor drum 12 is irradiated with a laser beam L from the exposure device 13 based on the image forming signal. The surface of the photoreceptor drum 12 is exposed by this later beam L, and an electrostatic latent image is formed thereon.

The electrostatic latent image formed on the photoreceptor drum 12 is developed into toner images of the respective colors of yellow, magenta, cyan and black with the developing roll 16 of the developing device 15, and the toner images are in turn primary-transferred to the intermediate transfer belt 30 one on top of the other at the first transfer site T1. Additionally, the transfer residual toner, remaining on the photoreceptor drum 12 after the primary transfer, is rubbed off and removed by means of the brush roll 20 of the cleaning device.

On the other hand, the paper sheets P accommodated in the paper feed tray 42 are fed out via the feed roll 44, separated by the retard roll 46, and only the uppermost paper sheet P is guided to the paper transport path 40, and then fed at a predetermined timing to between the secondary transfer roll 36 and the secondary transfer backup roll 34, i.e., to the secondary transfer portion T2. At this secondary transfer portion T2, the toner images primary-transferred to the intermediate transfer belt 30 are secondary-transferred to the paper sheet P. The paper sheet P having the toner images transferred thereon is transported downstream along the paper transfer path 40, and guided to the fixing device 50; the toner images are fixed due to heat and pressure applied by the heating roll 52 and pressure roll 54. Thereafter, the paper sheet P having the image formed thereon by fixation of the toner images is discharged to a catch tray (not shown) by means of the discharge rolls 56. The transfer residual toner remaining in the image region of the intermediate transfer belt 30 after the second transfer is rubbed off and removed by the intermediate transfer belt cleaner 38.

According to the operation as described above, the image forming apparatus 10 forms a color image on the paper sheet P.

<Construction of the Charging Roll and Cleaning Device>

Next, the charging roll 14 provided in the image forming apparatus 10 of the above construction and a cleaning device 100 for cleaning the charging roll 14 will be described in detail.

Figure 2:
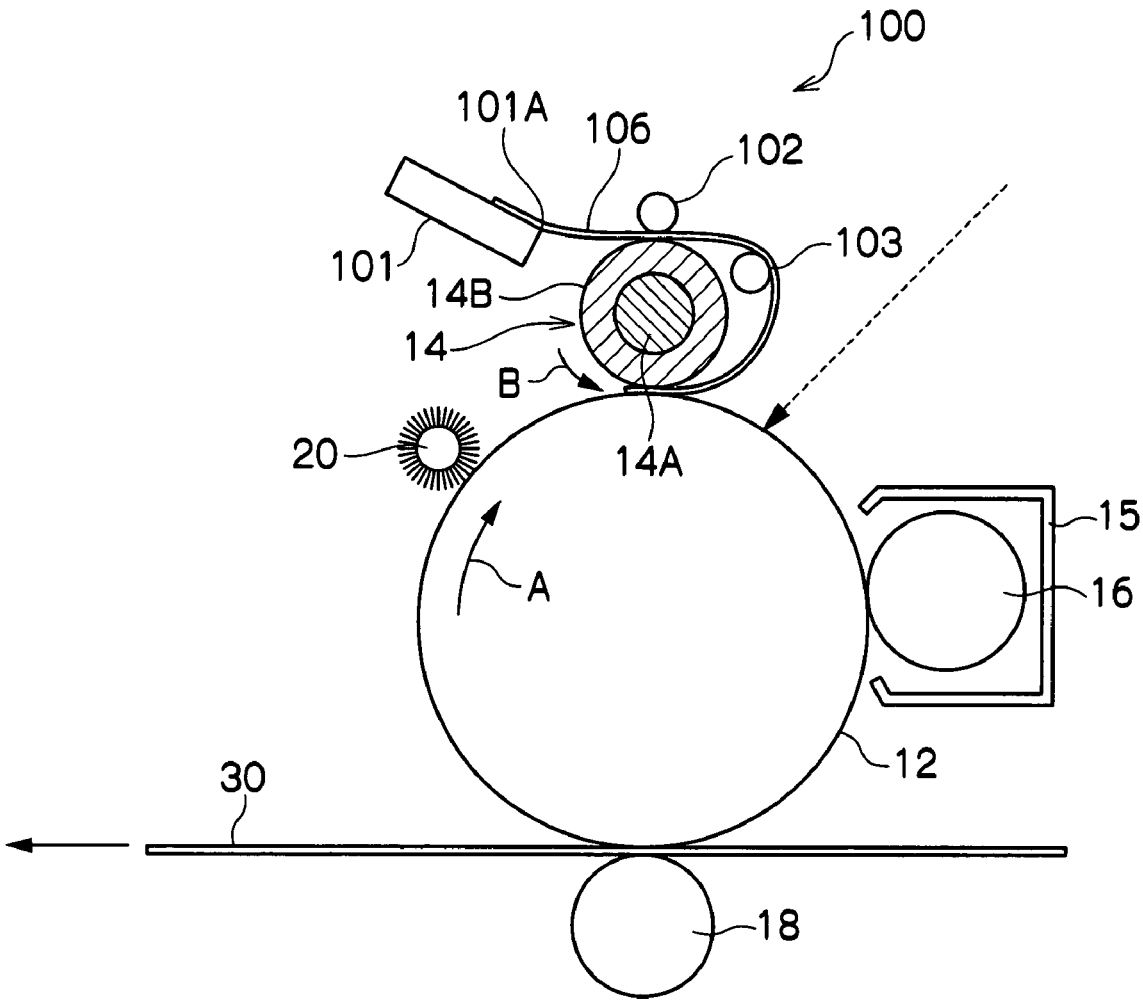
FIG. 2 is a first schematic diagram showing a first exemplary embodiment of the invention at the shipping stage.

As illustrated in FIG. 2, the charging roll 14 is provided above the photoreceptor drum 12 and in a manner that makes contact with the photoreceptor drum 12. The charging roll 14 includes a conductive shaft 14A and a charging layer 14B provided on the circumferential surface of the conductive shaft 14A. The shaft 14A is supported for rotation. A sheet-like cleaning member 106 is disposed in contact with the surface of the charging roll 14, one end thereof fixed to a substrate 101, the other end thereof being a free end. The free end side lower surface of the cleaning member 106 is disposed in contact with the surface of the charging roll 14.

The cleaning member 106 is pressed against the charging roll 14 in such a manner that embeds itself into the charging roll 14 to a predetermined extent, thereby facilitating removal of foreign matter such as a toner or an external additive adhered to the surface of the charging roll 14. The photoreceptor drum 12 is rotationally driven in the direction indicated by arrow A of FIG. 2 (clockwise direction) by a motor (not shown); and the rotation of the photoreceptor drum 12 causes the charging roll 14 to be rotated in the direction indicated by arrow B (counterclockwise direction).

The charging roll 14 and cleaning member 106 of this exemplary embodiment will now be described.

The charging roll 14, as described above, is placed in contact with the surface of the photoreceptor drum 12; a DC voltage or a voltage obtained by superimposing an AC voltage upon a DC voltage is applied to charge the surface of the photoreceptor drum 12. The charging roll is configured in a roll shape in which a resistive elastic layer forming the charging layer 14B is provided surrounding the circumferential surface of a core forming the shaft 14A. The resistive elastic layer has a configuration of a partitioned resistive layer and an elastic layer supporting it, in the named order from the outside. Further, in order to impart durability and staining resistance to the charging roll 14, a protective layer may be provided outside the resistive layer as occasion demands.

The case where the elastic layer, resistive layer and protective layer are provided on the core will be described in more detail hereinafter.

The material of the core has conductivity and generally uses iron, copper, brass, stainless steel, aluminum, nickel, or the like. Other materials than the metals can be used so long as they have conductivity and appropriate rigidity; the examples that can also be used include resin molded articles having conductive particles or the like dispersed therein, ceramics, and the like. A hollow pipe shape may be used instead of the roll shape.

The material for the elastic layer has conductivity or semi-conductivity, and is generally a resin material or rubber material having conductive particles or semi-conductive particles dispersed therein. Examples of the resin material include synthetic resins such as polyester resins, acrylic resins, melamine resins, epoxy resins, urethane resins, silicone resins, urea resins and polyamide resins, and the like, and examples of the rubber material include ethylene-propylene rubber, polybutadiene, natural rubber, polyisobutylene, chloroprene rubber, silicone rubber, urethane rubber, epichlorohydrin rubber, chlorosilicone rubber, ethylene oxide rubber, and the like, and foamed materials thereof.

Examples of the conductive particles or semi-conductive particles include: carbon black; metals such as zinc, aluminum, copper, iron, nickel, chromium and titanium metal oxides such as Zn—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO and MgO; and ionic compounds such as quaternary ammonium salts. These materials may be used alone or in a mixture of two or more of them. Further, one or more of inorganic fillers such as talc, alumina and silica, and organic fillers such as fine powders of fluorine resins and silicon rubber may be mixed therewith, as needed.

Materials of the resistive layer and protective layer are materials that are made by dispersing conductive particles or semi-conductive particles in a binder resin and controlling the resistance of the resulting material; its resistivity is from $10^3$ to $10^{14}$ Ωcm, preferably from $10^5$ to $10^{12}$ Ωcm, more preferably from $10^7$ to $10^{12}$ Ωcm. The film thickness is from 0.01 to 1000 μm, preferably from 0.1 to 500 μm, more preferably from 0.5 to 100 μm. Examples of the binder resins include polyolefin resins such as acrylic resins, cellulose resins, polyamide resins, methoxymethlated nylon, ethoxymethlated nylon, polyurethane resins, polycarbonate resins, polyester resins, polyethylene resins, polyvinyl resins, polyacrylate resins, polythiophene resins, PFA, FEP and PET, styrene-butadiene resins, melamine resins, epoxy resins, urethane resins, silicone resins, urea resins, and the like.

The conductive or semi-conductive particles include carbon black, metals and metal oxides similar to the case of the elastic layer, ionic compounds such as quaternary ammonium salts exhibiting ionic conductivity, and the like; one or more of them are mixed therewith. Further, as required, one or more of antioxidants such as hindered phenol and hindered amines, inorganic fillers such as clay, kaolin, talc, silica and alumina, organic fillers such as fine powders of fluorine resins and silicone resins, and lubricants such as silicone oils, and the like, can be added thereto. Further, as required, a surfactant, charge controller or the like is added thereto.

Examples of the means for forming these layers include a blade coating method, Mayer bar coating method, spray coating method, dip coating method, bead coating method, air knife coating method, curtain coating process, and the like.

The cleaning member 106 of the charging roll according to this exemplary embodiment is, as shown in FIG. 2, a sheet-like member having flexibility, which is placed in the longitudinal direction (axial direction) of the charging roll 14 and is fixed at one end thereof to the substrate 101 with an adhesive or the like, with the free-end side undersurface thereof placed in a manner that forms a contact nip between it and the charging roll 14.

The cleaning member 106 uses a resin film containing PET as a primary component having a film thickness of 50 μm, and is made to contact with the charging roll 14 with a bite-in amount of 1.0 mm in relation to the charging roll 14 (as defined in terms of the maximum value δ of bite-in amount between the surface of the charging roll 14 and the cleaning member 106) at a position apart by L=about 10 mm from the end 101A fixed to the substrate 101 and with a contact nip width of n=about 0.6 mm.

Further, since a force by which the cleaning member 106 is made to contact with the charging roll 14 is produced due to a repulsive force resulting from the cleaning member 106 being flexed, the contact nip width n can be limited to about 0.6 mm, and the change in contact pressure due to a change in the bite-in amount is small, so that the cleaning member 106 can be made to evenly contact with the charging roll 14 at a low pressure in the entire region of the charging roll. Thus, a contaminant rubbed off from the charging roll does not remain within the contact nip. Consequently, the occurrence of flaws in the charging roll surface due to being rubbed by contaminant stuck within the contact nip between the charging roll and the cleaning member 106 can be suppressed to an extent such that no influence is imparted to an image.

The cleaning member 106 of the charging roll 14 can be formed not only by using PET directly as described above but also by using a resin film that is appropriately roughened by a grinder method or sand blast method, a chemical etching process, or a fine particle dispersion process.

Examples of the sheet material include, besides PET, resins such as polyimides, phenol resins, diallyl phthalates, polyethylene, polypropylene, polycarbonate, polyarylate, polyester, epoxy resins, polyphenylene sulfide, polyether imides, polyamides, polystyrene and polymethylmethacrylate, fluorine resins such as PTFE and PVDF, and the like. Adherence of a sponge material such as polyurethane to the sheet materials can result in improved cleaning performance. Further, by adhering a brush pad having a brush length of about 2 mm to the sheet materials, external additives firmly adhered to the surface of the charging roll 14 can be effectively cleaned.

The sheet film thickness, sheet bite-in amount, etc. are not limited to the above set values. The optimal values may be selected as appropriate depending on the life of the charging roll 14, the characteristics of a toner to be used, the performance of the brush roll 20 for cleaning the photoreceptor drum 12, etc. However, the film thickness and the sheet bite-in amount preferably range from 10 to 500 μm and from 0.1 to 2 mm, respectively.

Next, the cleaning member according to the first exemplary embodiment will be described.

Figure 3:
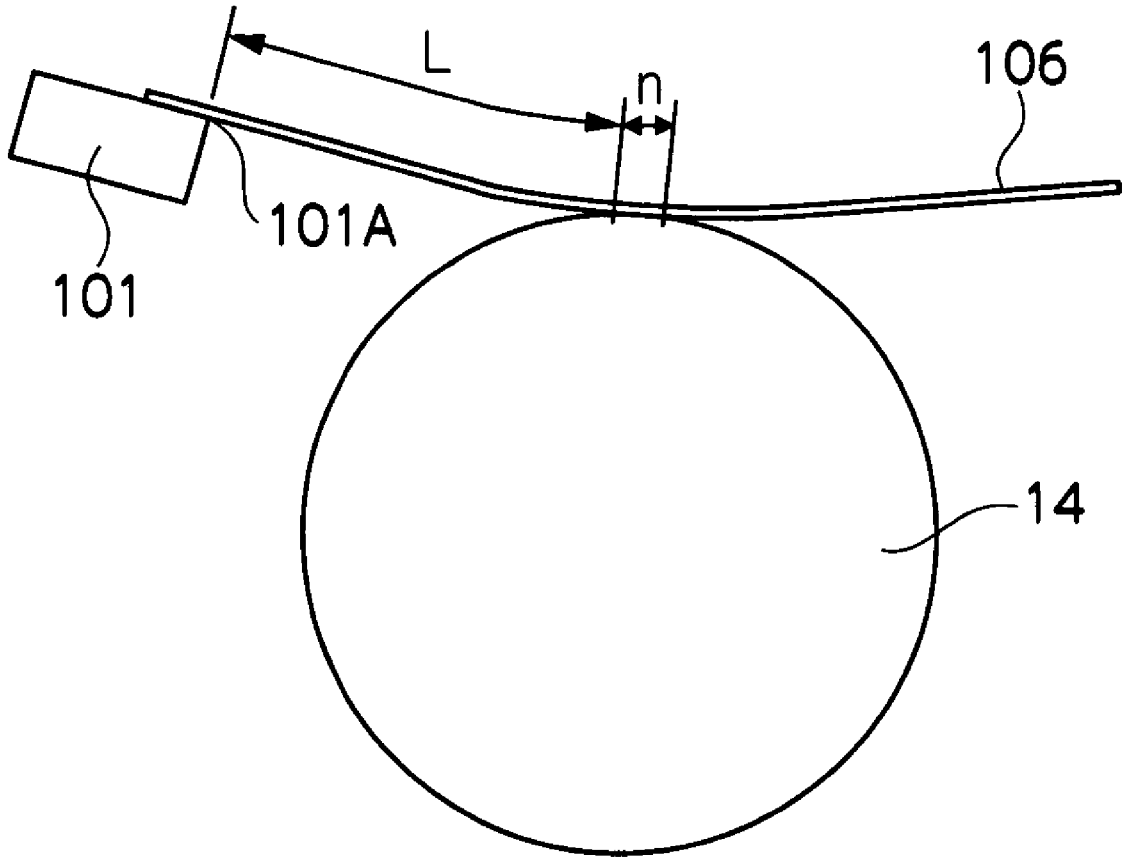
FIG. 3 is a schematic diagram showing the contact relationship between a cleaning member and a charging roll of the first exemplary embodiment of the invention.

As shown in FIG. 3, the free end side undersurface of the cleaning member 106 fixed at one end to the substrate 101 is in contact with and cleans the surface of the charging roll 14. Although the cleaning member 106 is in contact with the surface of the charging roll 14 with a bite-in amount as indicated previously, a structure may also be used in which a pressing member 102 and the charging roll 14 hold the cleaning member 106 therebetween in order to maintain stable contact performance.

Figure 4:
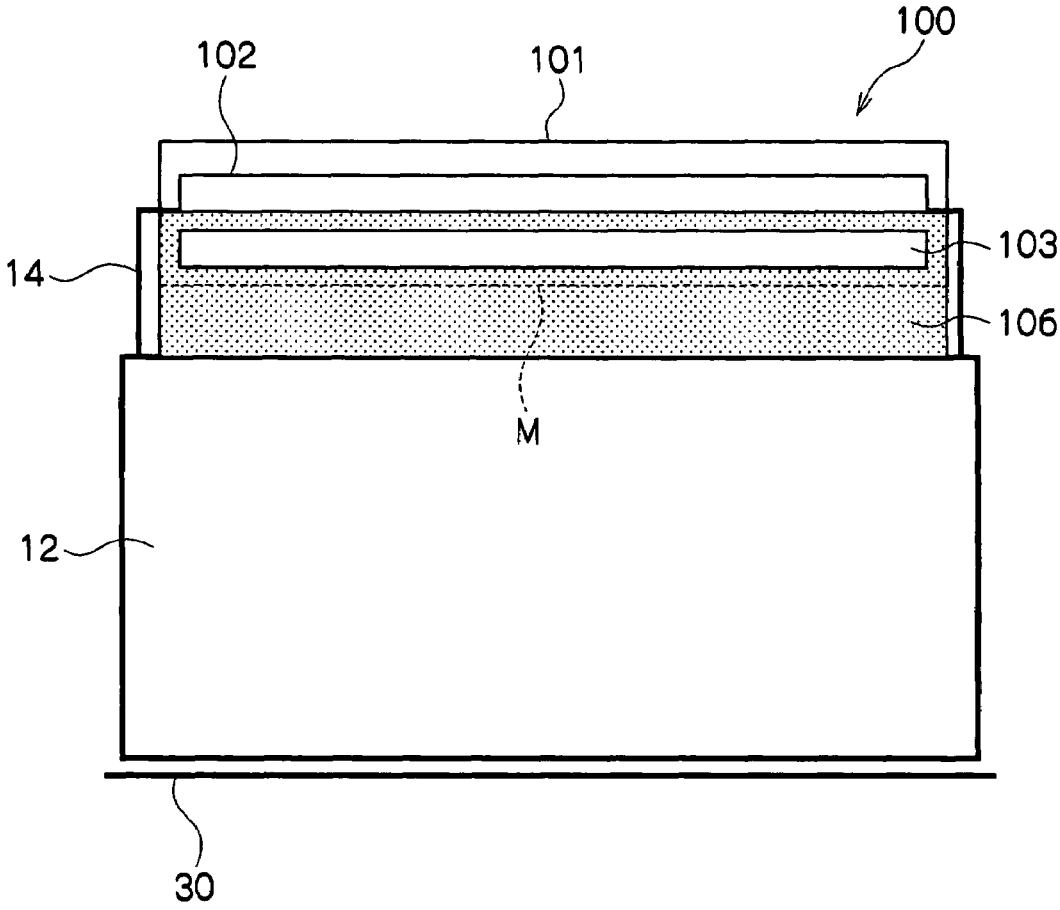
FIG. 4 is a second schematic diagram showing the first exemplary embodiment of the invention at the shipping stage.

The free end side portion of the cleaning member 106 is configured so as to have a length such that: it may be wound around about half of the periphery of, and bend on, a fold back member 103, the fold back member 103 having a distance from, and being placed in parallel to, the charging roll 14; and then be inserted in between the charging roll 14 and the image carrier 12. A schematic view of this configuration as viewed from a cylindrical surface side of the image carrier 12 is shown in FIG. 4. The width over which the cleaning member 106 extends in the axial direction of the charging roll 14 is preferably set to be equal to or less than the width of the charged region of the charging roll 14, and greater than the width of the developable region of the developing roll 16 (see FIG. 2). Here, the image forming apparatus is shipped with the free end portion of the cleaning member 106 inserted in between the charging roll 14 and the image carrier 12 at the shipping stage, and an operator pulls out the free end portion during the setting-up operation of the apparatus. This enables the prevention of flaws and histories remaining on the surfaces of the charging roll 14 and image carrier 12 due to vibration during transport, and enables the maintenance of good condition image formation after installation.

Figure 5:
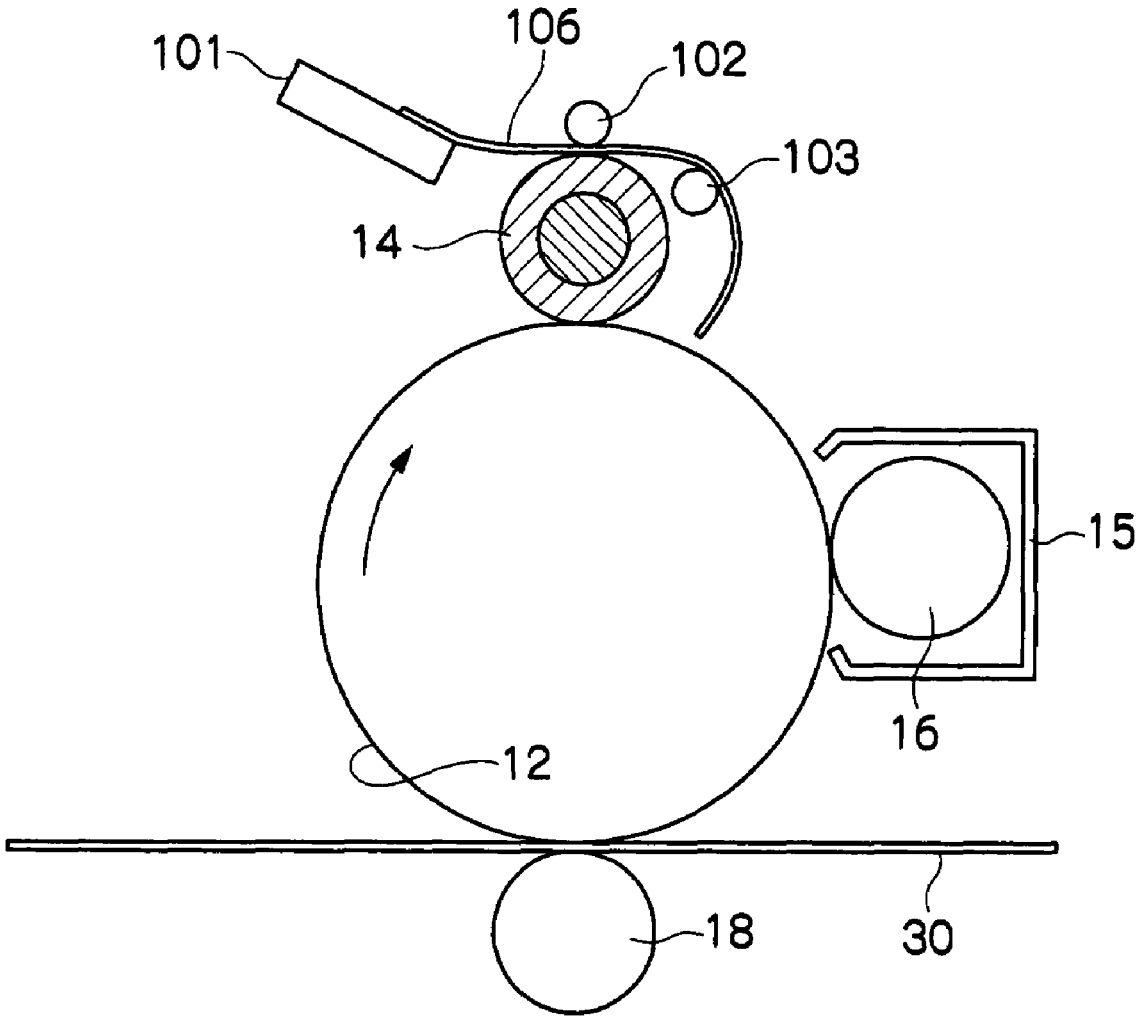
FIG. 5 is a schematic diagram showing the first exemplary embodiment of the invention during image forming operation.

Further, the cleaning member 106 pulled out of between the charging roll 14 and image carrier 12 hangs down from the fold back member 103 as shown in FIG. 5, and can also serve as a covering member for preventing movement of a toner cloud from the developing roll 16 to the charging roll 14, in the space between the charging roll 14 and the developing roll 16. Alternatively, in a configuration in which a sufficient space is unavailable between the charging roll 14 and the developing roll 16, due to the apparatus being miniaturized, it is possible that the hanging-down portion of the cleaning member 106 may be removed by cutting off the cleaning member along a perforation M of the cleaning member 106 shown in FIG. 4.

Instead of the system in which an operator pulls out the free end portion of the cleaning member 106 when the image forming apparatus is installed, a system may be adopted in which the image carrier 12 and the charging roll 14 are initially rotated, and the cleaning member 106 is automatically pulled out by due to the rotational forces of the image carrier 12 and the charging roll 14. With such a system, the operator can carry out the operation for pulling out the cleaning member 106 without touching the image carrier 12 and charging roll 14 in the apparatus, so that the time for the installation operation can be reduced.

Next, a cleaning member 108 according to a second exemplary embodiment will be described.

Figure 6:
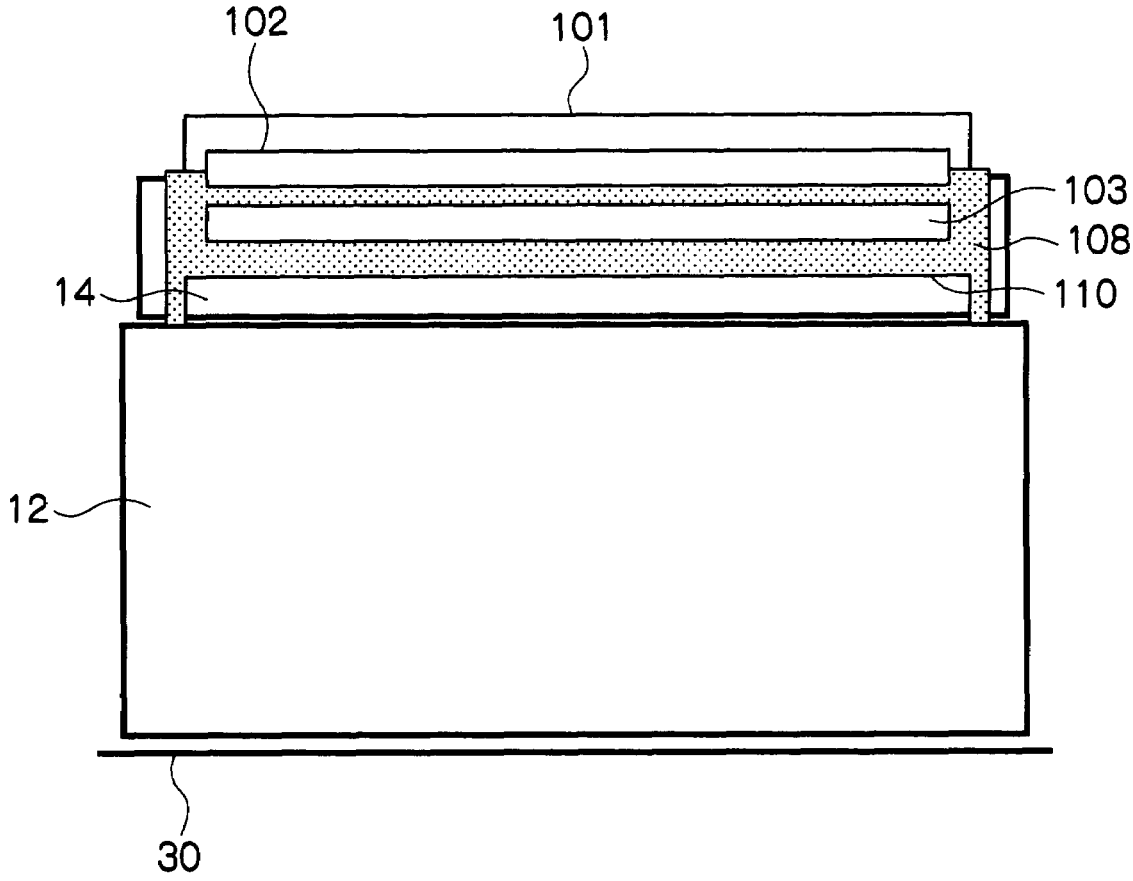
FIG. 6 is a schematic diagram showing a second exemplary embodiment of the invention at the shipping stage.

As shown in FIG. 6, the cleaning member 108 of this exemplary embodiment is formed with a cut-out portion 110 between the fold back member 103 and a position where the cleaning member is held between the charging roll 14 and image carrier 12. The surface of the charging roll 14 is exposed from this cut-out portion 110.

Since, except for this cut-out portion 110, the cleaning member 108 is held between the charging roll 14 and the image carrier 12 and interposed between the charging roll 14 and the image carrier 12 with a fixing member (not shown), the charging roll 14 and the image carrier 12 are placed in extremely close proximity to each other while keeping a separation of about 10 to about 500 μm, so that when a discharge phenomenon is induced, the charging roll 14 is enabled to perform the function of charging the image carrier 12. Thus, in this case, the cleaning member 108 provided at the opposite ends of the charging roll not only prevents contact history at the shipment stage, but also serves as an separation-keeping member for keeping the separation between the charging roll 14 and image carrier 12 after the apparatus is installed.

As in the first exemplary embodiment, the charging roll 14 is exposed in the surface area which is minimally required for charging the image carrier 12, and the remaining portion can serve also as a covering member that prevents the adherence of a toner cloud or the like.

Figure 7A:
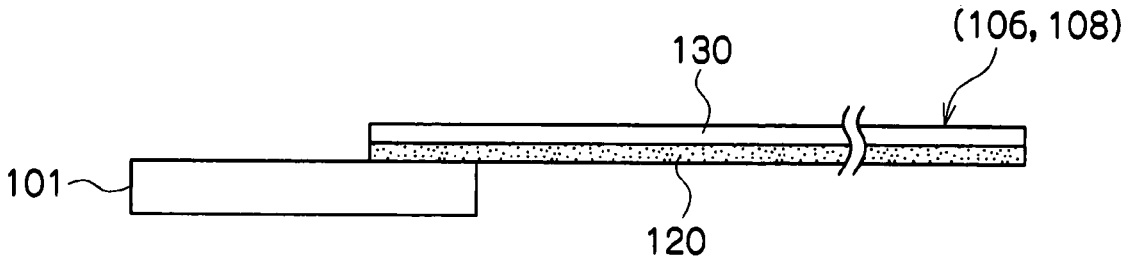
FIGS. 7A and 7B are first detailed views showing a cleaning member of the invention.
Figure 7B:
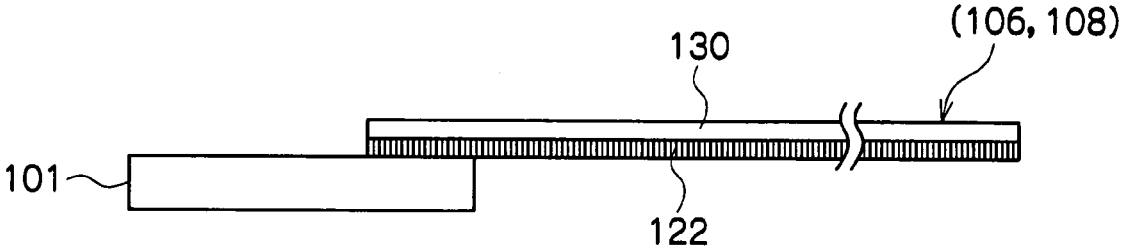

In the first and second exemplary embodiments described above, in order to effectively achieve the functions of the cleaning members 106 and 108, a configuration, which is described below, may be used. That is, as shown in FIGS. 7A and 7B, a material such as a polyurethane material 120 or a brush material 122 is provided on the face of the cleaning member which is fixed to the substrate 101. Since this face contacts with the surface of the charging roll 14 resulting in being a cleaning face, by using these materials, it is possible to effectively remove foreign matter such as a toner or external additive.

In FIG. 7A, with the surface roughness changed between a first surface 102, whose fore end portion contacts with the surface of the photoreceptor drum 12, and a second surface 103, which contacts with the surface of the charging roll 14, the pulling-out of the cleaning member 106 can be effectively carried out. In particular, in the case where the cleaning member 106 is configured in a single-sheet form, the present invention can be readily achieved by the setting of the surface roughness.

In order for the photoreceptor drum 12 not to be flawed, the surface roughness of the first surface 120 is preferably 3 μm or less in terms of Rz (ten-point mean roughness). In this case, when the surface roughness is 3 μm or more, the surface of the photoreceptor drum 12 is slightly flawed when the cleaning member is pulled out, so that an image quality defect such as a color stripe tends to occur during formation of an image.

On the other hand, the second surface 130, which contacts with the charging roll 14, preferably has a specified roughness for preventing slippage when the cleaning member is pulled out. In this case, by making the surface roughness to be 4 μm or more in terms of Rz (ten-point mean roughness), it is possible to effectively prevent slippage of the cleaning member 106 when it is pulled out.

In the present exemplary embodiment, it is confirmed that the surface roughness of the photoreceptor drum 12 and that of the charging roll 14 are 0.5 μm and 3 μm in terms of Rz, respectively. Thus, by setting the surface roughness to be different between the first surface and the second surface, it is possible to prevent slippage when the cleaning member is pulled out, while preventing the photoreceptor drum surface from being flawed.

Figure 8A:
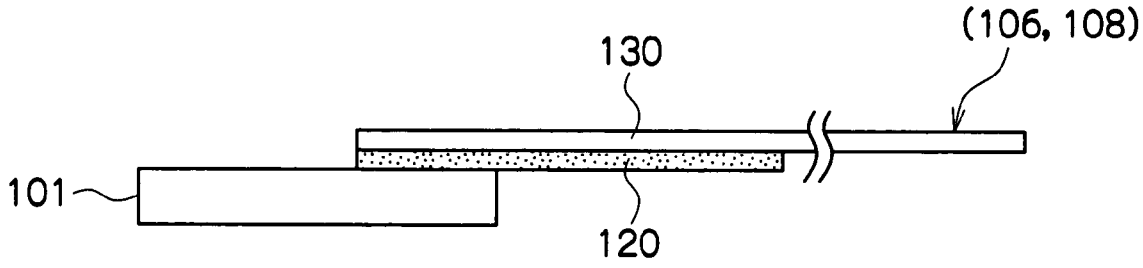
FIGS. 8A and 8A are second detailed views showing a cleaning member of the invention.
Figure 8B:
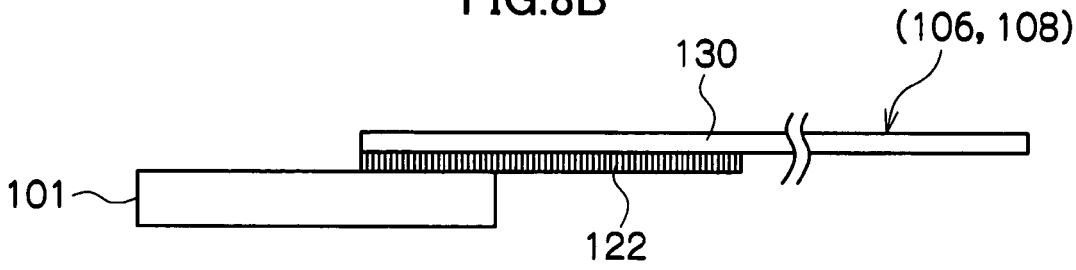
Figure 9A:
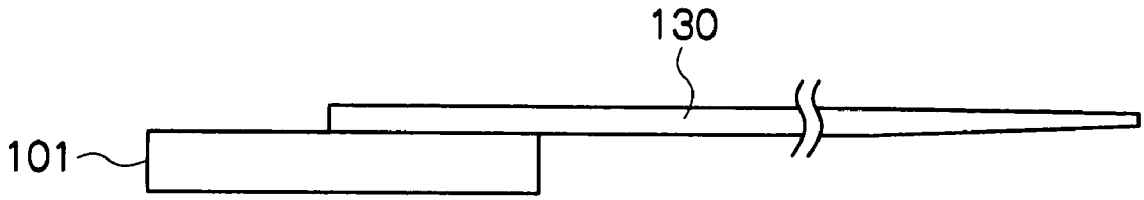
FIGS. 9A and 9B are third detailed views showing a cleaning member of the invention.
Figure 9B:
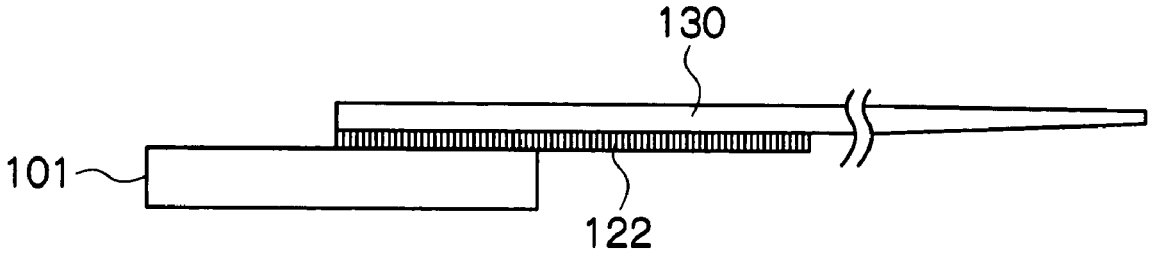

As illustrated in FIGS. 8A and 8B, it is also possible that either a polyurethane material 120 or a brush material 122, which is suited to serve to the cleaning function, may be used at the part to be fixed to the substrate 110 and the surface that cleans the surface of the charging roll as described above, and the free end side portion may be formed only by a film material of PET or the like. Further, as shown in FIGS. 9A and 9B, the portion held between the charging roll 14 and image carrier 12 may be configured in a manner that becomes thinner toward the fore end. With such a configuration, when the installation operation or the operation for pulling out the cleaning member 106, 108 by rotating the image carrier 12 is performed, it possible to easily perform the pulling-out operation without causing the surfaces of the charging roll 14 and image carrier 12 to be flawed.

Further, when a system is adopted in which rotating the image carrier 12 and the charging roll 14 are rotated during installation operation and the cleaning member 106, 108 is automatically pulled out due to the rotational force of the image carrier 12 and charging roll 14, the rotational speeds of the image carrier 12 and charging roll 14 during the pulling out operation are preferably set to be slower than the normal rotational speed during formation of an image in order to prevent in advance the problem that slippage of the cleaning member is caused between the charging roll 14 and image carrier 12 when the cleaning member is pulled out.

The present invention will be more specifically described with reference examples thereof hereinafter, but the scope of the invention is of course not limited thereto.

EXAMPLE 1

This Example is carried out using an image forming apparatus 10 structured as shown in FIGS. 1 and 2. More specifically, an example of the cleaning member 106 of FIG. 7 is used in which a sheet-like polyurethane material 120 is laminated to a PET sheet member 130, and the resultant configuration is fixed to a substrate 101. Here, the PET sheet member is 50 μm thick, and the layer thickness of the polyurethane material is 250 μm thick. The length of the portion of the cleaning member 106 which is adhered to the substrate 101 is 10 mm; the entire length the portion of the cleaning member which extends from the substrate 101 is 250 mm; and the width of the latter portion is 320 mm. The number of cells in the surface of the polyurethane material is set to be 55 cells/25 mm.

A method of producing, for example, a polyurethane material will be simply described. The polyurethane material is produced by using polyol, isocyanate, water, a catalyst (amine catalyst, metal catalyst or the like), and a foam stabilizer (surfactant). Additionally, an additive is used depending on applications. Such raw materials are mixed and agitated, and thus chemical reaction is caused, as a result of which a foamed urethane resin material is obtained.

This cleaning member 106 is inserted in between the charging roll 14 and the image carrier 12. Here, the outer diameter of the charging roll 14 is 18 mm, and the outer diameter of the image carrier is 60 mm. The portion of the cleaning member 106 which is held between the charging roll 14 and the image carrier 12 is located at a position which is 10 mm apart from the fore end of the sheet member, and the cleaning member 106 is disposed in contact between the charging roll 14 and the image carrier 12 over length of about 1.5 mm.

A transport-induced vibration test of the apparatus is conducted in a state such that the cleaning member 106 is inserted in between the charging roll 14 and the image carrier 12 as described above. The result of the test is that no history due to abrasion remains in the surfaces of the image carrier 12 and charging roll 14 and no conductive material oozed from the surface layer of the charging roll 14 adheres to the surface of the image carrier.

Further, after the transport-induced vibration test is finished, it is confirmed that the cleaning member 106 can be pulled out through a rotation of the image carrier 12. Here, the normal process speed of the present image forming apparatus is such that the rotational speed at the surface of the image carrier 12 is 264 mm/sec, and even at such a rotational speed, the cleaning member 106 can be pulled out without slipping. By contrast, when the cleaning member 106 is pulled out, on a trial basis, with the rotational speed of the image carrier 12 being at 350 mm/sec and 420 mm/sec, frictional slippage occurs at the surfaces of the cleaning member 106 and image carrier 12, and consequently, it is confirmed that pulling out the cleaning member 106 is slowed. Further, when the rotational speed of the image carrier is changed to be at 220 mm/sec, 160 mm/sec, 110 mm/sec, and 60 mm/sec, on a trial basis, the cleaning member 106 can be pulled out without slipping in all the cases.

Evaluations are conducted with respect to cases where the operator pulls out the cleaning member 106 in a similar manner, and it is confirmed that no flaws are attached and the operation can be performed easily. Additionally, it comes to be confirmed that the cleaning member 106 has a function of removing foreign matter such as a toner and external additive adhered to the surface of the charging roll 14, and that no concentration unevenness or striping due to foreign matter attached to the charging roll or the like is caused even when printing of 100,000 sheets is completed. Further, it can be confirmed that, after the evaluations are completed, cloud toners are attached to the developing roll 15 side portion of the cleaning member 106 which is pulled out from between the charging roll 14 and the developing roll 15, and that the cleaning member 106 serves as a covering member that prevents these toner clouds from being attached to the charging roll 14 during the printing operation.

EXAMPLE 2

Next, a second example will be described in which a brush type is used as a material for the cleaning member 106 in the configuration of Example 1 shown above. Namely, for the cleaning member 106 of FIG. 7B, use is made of a member in which a brush material 122 having a brush length of 1 mm is laminated to a PET sheet material 130, the laminated configuration being fixed to the substrate 101. Other shapes and materials of the material are similar to those in Example 1. Further, the above brush portion uses a brush sheet fabricated by arranging in parallel conductive rayon resin fibers having a diameter of about 100 μm and being formed to a thickness of about 1 mm and configured such that the ends of the brush portion contact with the charging roll with a bite-in amount of 0.5 mm.

Figure 10:
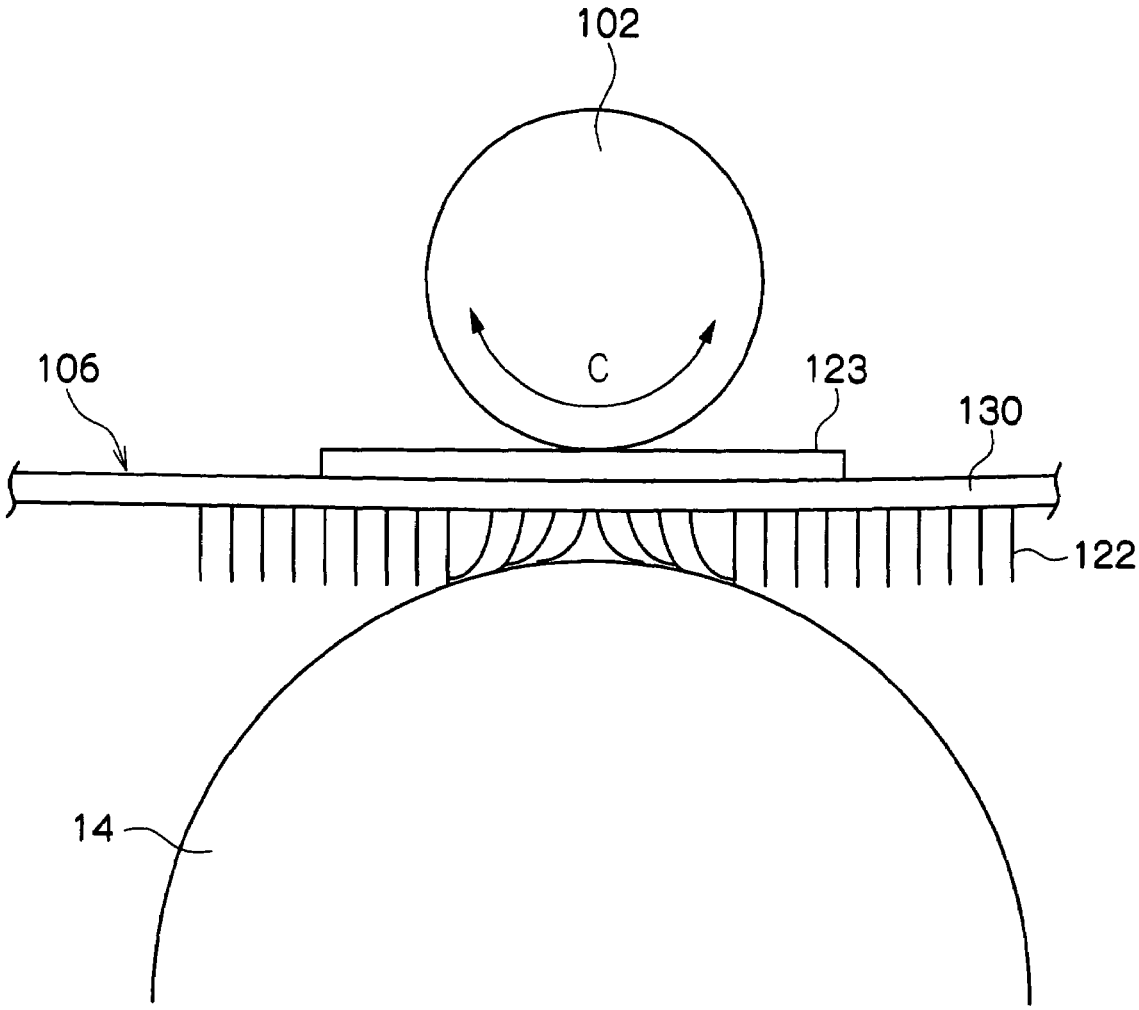
FIG. 10 is a forth detailed view showing a cleaning member of the invention.

In this example as well, it is confirmed that an effect similar to that of Example 1 can be produced by inserting the cleaning member 106 in between the charging roll 14 and the image carrier 12. Additionally, the fore end of the brush material 122 laminated to the sheet material 130 is caused to slidingly engage the surface of the charging roll 14, thereby effectively removing foreign matter such as a toner and external additive attached to the surface. In this example, since if the cleaning member 106 continues contacting the charging roll 14 as shown in FIG. 10, the brush bristles in contact with the charging roll 14 develop a permanent bend and the cleaning performance is slightly decreased, a friction member 123 is provided the back face of the sheet material 130, and a pressure member 102 is rotated in contact therewith, thereby straightening the brush bristles. Thus, high cleaning performance can be maintained even in this example using a brush.

EXAMPLE 3

Figure 11:
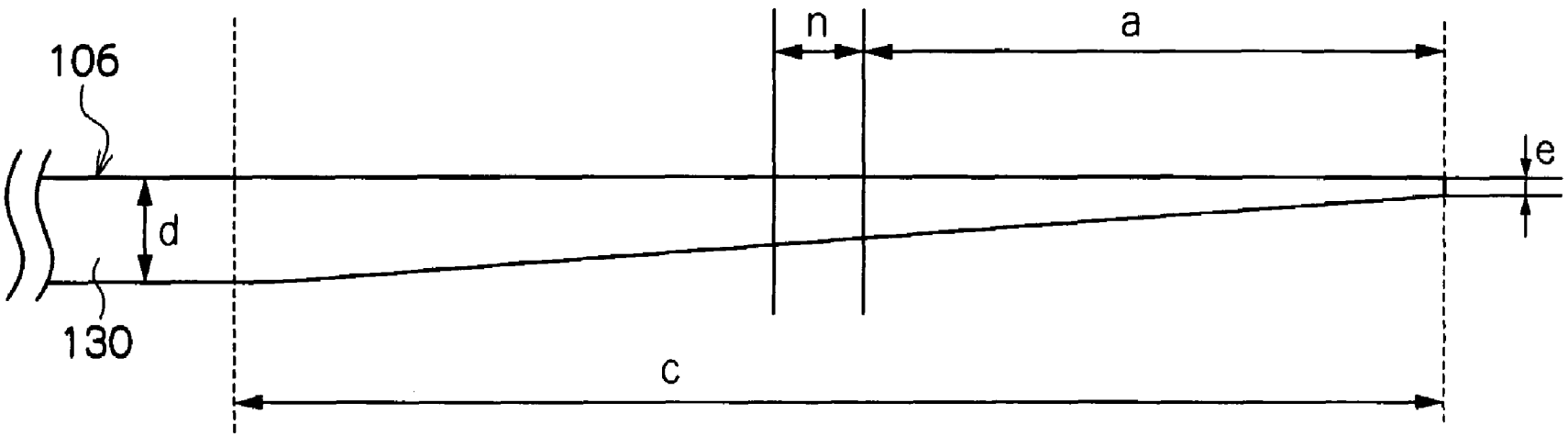
FIG. 11 is a fifth detailed view showing a cleaning member of the invention.

Next, a third example of the cleaning device embodying the present invention will be described. The third example uses the shape of FIG. 9A or 9B as the shape of the free end portion of the cleaning member in the configuration of Example 1 shown above. The remaining portions of the configuration are the same as those in Example 1. Here, as shown in FIG. 11, a PET sheet material 130 having a thickness of d=50 μm is configured such that it is tapered over a length of c=22 mm at the front end side thereof. In this case, the sheet material 130 is contacted at its upper surface by the image carrier 12 and at its lower surface by the charging roll 14 as viewed in FIG. 11. The thickness of the front end is e=10 μm. The distance a from the front end to the portion, which is contacted by the image carrier 12, is 10 mm. The area n where sheet material 130 contacts with the image carrier 12 is about 1.5 mm long.

In the present exemplary embodiment, the pulling-out force needed for an operator to pull out the cleaning member 106 during installation of the apparatus is decreased from 800 g to 450 g, as compared with Example 1. The length of the sheet material in the axial direction of the charging roll 14 is 300 mm, and it follows that the pulling-out force per unit length is decreased from 2.67 (g/mm) to 1.5 (g/mm). Further, as a result of transport-induced vibration tests conducted in a manner similar to those conducted in Example 1, it is confirmed that the cleaning member, which is configured according to the present example, functions to prevent initial contact without flawing the image carrier 12 and charging roll 14.

As will be appreciated from the above, the cleaning device according to an exemplary embodiment of the present invention is capable of preventing the image carrier and the charging roll from contacting with each other, for example, at the shipping stage of the image forming apparatus, thereby decreasing image defects which are otherwise likely to be caused due to contact between the image carrier and the charging roll.

What is claimed is:

1. A cleaning device, comprising:

a cleaning member, in the form of a flexible sheet, that cleans a surface of a charging roll that charges an image carrier;

the cleaning member being fixed at one end thereof, a surface on a free end of the cleaning member being disposed in contact with the surface of the charging roll, and the free end of the cleaning member being flexed around the charging roll and inserted in between the image carrier and the charging roll.

2. The cleaning device of claim 1, wherein the free end of the cleaning member is capable of being pulled out from between the image carrier and the charging roll through rotation of the image carrier.

3. The cleaning device of claim 1, wherein at least a portion of the cleaning member comprises a plurality of layers.

4. The cleaning device of claim 2, wherein at least a portion of the cleaning member comprises a plurality of layers.

5. The cleaning device of claim 1, wherein the cleaning member has a first surface and a second surface that have different surface roughnesses to each other.

6. The cleaning device of claim 5, wherein the first surface and the second surface are disposed opposite with each other.

7. The cleaning device of claim 5, wherein the first surface has a smaller surface roughness than the second surface, the first surface being in contact with the surface of the image carrier, and the second surface has a larger surface roughness than the first surface, the second surface being in contact with the charging roll.

8. The cleaning device of claim 2, wherein the cleaning member has a first surface and a second surface that have different surface roughnesses to each other.

9. The cleaning device of claim 8, wherein the first surface and the second surface are disposed opposite with each other.

10. The cleaning device of claim 8, wherein the first surface has a smaller surface roughness than the second surface, the first surface being in contact with the surface of the image carrier, and the second surface has a larger surface roughness than the first surface, the second surface being in contact with the charging roll.

11. The cleaning device of claim 3, wherein the portion of the cleaning member, which comprises the plurality of layers, comprises a film layer and sponge layer.

12. The cleaning device of claim 4, wherein the portion of the cleaning member, which comprises the plurality of layers, comprises a film layer and sponge layer.

13. The cleaning device of claim 1, wherein the free end of the cleaning member inserted in between the image carrier and the charging roll becomes thinner toward the distal end.

14. The cleaning device of claim 2, wherein the free end of the cleaning member inserted in between the image carrier and the charging roll becomes thinner toward the distal end.

15. The cleaning device of claim 3, wherein the free end of the cleaning member inserted in between the image carrier and the charging roll becomes thinner toward the distal end.

16. An image forming apparatus comprising the cleaning device of claim 1.

17. An image forming apparatus comprising the cleaning device of claim 2.

18. An image forming apparatus comprising the cleaning device of claim 2, wherein when the free end of the cleaning member is pulled out from between the image carrier and the charging roll, the image carrier is rotated at a lower speed than during normal image forming operation.

19. The cleaning device of claim 1, wherein the free end of the cleaning member, which is inserted in between the image carrier and the charging roll, also serves as a separation-maintaining member to maintain a predetermined separation between the image carrier and the charging roll.

20. The cleaning device of claim 1, wherein the cleaning member further comprises: a first region to clean the charging roll; and a second region to contact with the image carrier; and a severation portion is provided between the first region and the second region so as to enable the cleaning member to be severed.

21. The cleaning device according to claim 3, wherein the portion of the cleaning member, which comprises the plurality of layers, comprises a film layer and brush layer.

22. The cleaning device according to claim 4, wherein the portion of the cleaning member, which comprises the plurality of layers, comprises a film layer and brush layer.

* * * * *